United States Patent [19]

Birch et al.

[11] 4,001,733

[45] Jan. 4, 1977

[54] FERRITE PHASE SHIFTER HAVING CONDUCTIVE MATERIAL PLATED AROUND FERRITE ASSEMBLY

[75] Inventors: James D. Birch, Townsend; Max C. Mohr, Burlington; Raymond C. Waterman, Jr., Townsend, all of Mass.

[73] Assignee: Raytheon Company, Lexington, Mass.

[22] Filed: Aug. 18, 1975

[21] Appl. No.: 605,789

[52] U.S. Cl. ..... 333/24.1; 333/98 R

[51] Int. Cl.[2] ..... H01P 1/40

[58] Field of Search ..... 333/1.1, 24.1, 24.2, 333/24.3, 73 W

[56] References Cited

UNITED STATES PATENTS

| | | | |
|---|---|---|---|
| 3,333,214 | 7/1967 | Parris | 333/24.2 X |
| 3,760,305 | 9/1973 | Mason et al. | 333/24.1 X |
| 3,761,845 | 9/1973 | Ajioka et al. | 333/24.1 |

*Primary Examiner*—Paul L. Gensler
*Attorney, Agent, or Firm*—Richard M. Sharkansky; Philip J. McFarland; Joseph D. Pannone

[57] ABSTRACT

A radio frequency phase shifter suitable for X-band operation is disclosed. Such phase shifter incudes a waveguide structure and a ferrite assembly disposed within such waveguide structure. The ferrite assembly has a conductive material plated on the sides thereof. A pair of such plated sides is in contact with the wide walls of the waveguide structure thereby preventing the generation of longitudinal section modes (i.e. $LSE_{1,1}$, $LSM_{1,1}$, and $LSE_{1,2}$) and another pair of such plated walls is displaced from the narrow walls of such waveguide structure to form a pair of waveguide sections cut off to the dominant mode of the radio frequency energy passing through the ferrite phase shifter thereby inhibiting such energy from coupling to wires passing through such waveguide sections for supplying drive current to the enclosed ferrite assembly. Because the waveguide structure may be flexed and has a width greater than the width of the ferrite assembly, the ferrite assembly may be inserted within the waveguide structure, when flexed, to provide the desired contact between the plated sides of the ferrite assembly and the wide walls of the waveguide structure when the latter returns to its original dimensions.

4 Claims, 3 Drawing Figures

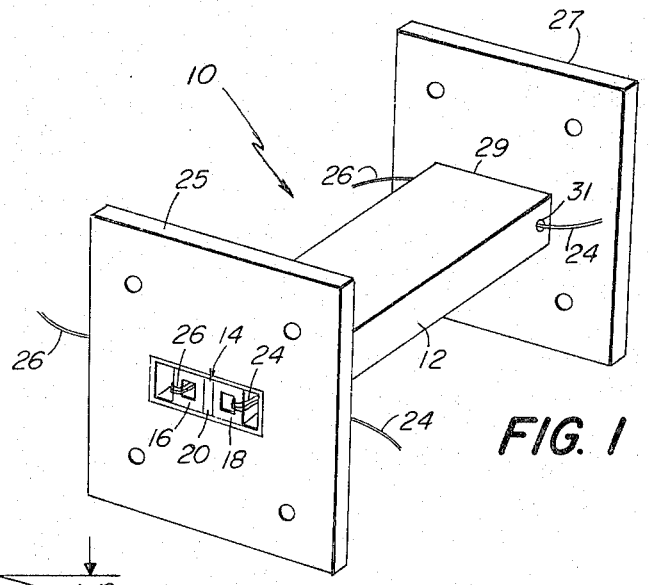
FIG. 1
FIG. 3
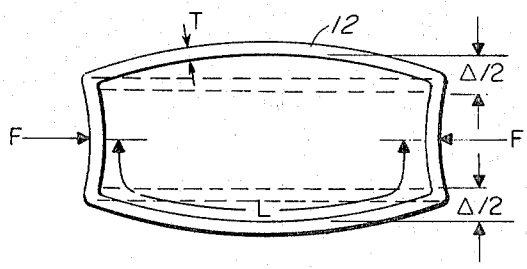
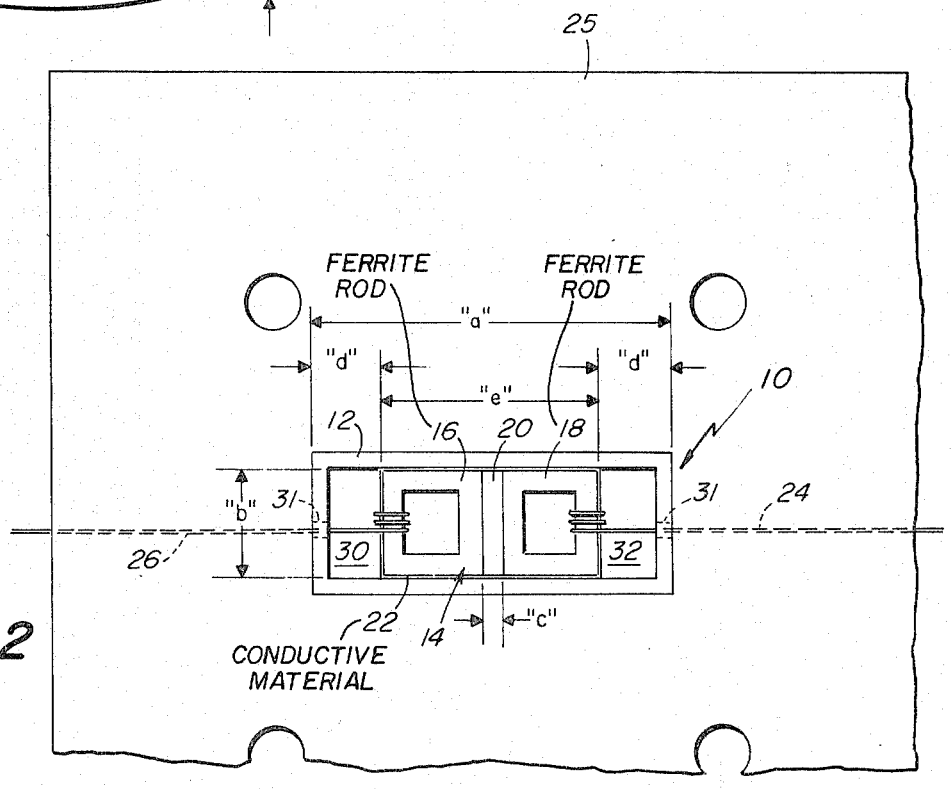
FIG. 2

FERRITE PHASE SHIFTER HAVING CONDUCTIVE MATERIAL PLATED AROUND FERRITE ASSEMBLY

BACKGROUND OF THE INVENTION

This invention relates generally to radio frequency phase shifters and more particularly to phase shifters of such type which are adapted for operation in the X-band frequency range from 8.0 to 12.5 GHz.

As is known in the art, radio frequency phase shifters have many applications such as in phased array antennas to collimate and direct a beam of radio frequency energy in a desired direction. One type of phase shifter includes a toroidal shaped ferrite rod disposed in a waveguide, the phase shift of radio frequency energy passing through the waveguide and ferrite rod being in accordance with the magnetic state of the ferrite rod. As is described in an article entitled "Longitudinal Section Mode Analysis of Dielectrically Loaded Rectangular Waveguides With Application To Phase Shifter Design" by G. N. Tsandoulas, D. H. Temme, and F. G. Willwerth, published in I.E.E.E. Transactions on Microwave Theory and Techniques, Vol. MTT-18, No. 2, Feb. 1970, longitudinal section modes (i.e. $LSE_{1,1}$, $LSM_{1,1}$ and $LSE_{1,2}$) may tend to propagate in such a phase shifter. These longitudinal section modes are excited because of discontinuities in the phase shifter, such as minute air gaps (less than tenths of a mil wide) between the ferrite rod and the waveguide walls which are supposedly in contact with each other. One technique suggested in the referenced article for reducing the effect of the longitudinal section modes is to reduce the height of the waveguide. However, at X-band frequencies, the height of the waveguide made according to such suggested technique should not be greater than 0.12 inches. Reducing the height of the waveguide to such a dimension, however, reduces the efficiency of the phase shifter.

SUMMARY OF THE INVENTION

With this background of the invention in mind it is therefore an object of this invention to provide an improved radio frequency phase shifter suitable for operation in the X-band frequency range.

This and other objects of the invention are attained generally by providing, in a radio frequency phase shifter, a waveguide structure and a ferrite assembly disposed in such waveguide structure, such ferrite assembly having a conductive material plated on the sides thereof. Opposite ones of such plated sides are in contact with the wide walls of the waveguide structure and the remaining ones of such plated sides are displaced from the narrow wall of such waveguide structure to form a pair of waveguide sections cut off to the dominant mode of the radio frequency energy passing through the ferrite phase shifter.

In a preferred embodiment, the ferrite assembly includes two rectangular ferrite rods, such rods being separated by a dielectric slab. The two ferrite rods and dielectric slab are plated with a conductive material to form the ferrite assembly. The width of such ferrite assembly is dimensioned to cut off higher unwanted modes when assembled in the waveguide structure. With such an arrangement, since the width of the waveguide structure is greater than the width of the ferrite assembly, the ferrite assembly may be inserted into the waveguide structure by applying forces on the opposing narrow walls of the waveguide structure thereby to flex the inner region of such waveguide structure within its mechanically elastic region allowing the insertion of the ferrite assembly when such waveguide section is so flexed. Once such ferrite assembly is so inserted, the forces on the narrow walls of the waveguide structure are removed thereby enabling the wide walls of the waveguide structure to return elastically to their normal position and thereby supply compressive forces on the ferrite assembly to fasten such ferrite assembly within such waveguide structure and effectively to eliminate any gaps in which energy may be propagated in undesired longitudinal modes. Because the amount of elastic deflection of the waveguide structure is related to the width of such waveguide structure, the width of the waveguide structure may be made greater than the width of the plated ferrite assembly thereby enabling the waveguide structure to be so deflected within its mechanically elastic region.

BRIEF DESCRIPTION OF THE DRAWINGS

The above mentioned and other features of the invention will become more apparent by reference to the following description taken in connection with the accompanying drawings in which:

FIG. 1 is an isometric drawing of a ferrite phase shifter according to the invention;

FIG. 2 is an end view of the ferrite phase shifter of FIG. 1; and

FIG. 3 is a sketch of the end view of the waveguide structure used in the ferrite phase shifter shown in FIG. 1, such sketch showing such waveguide in its flexed and unflexed conditions.

DESCRIPTION OF THE PREFERRED EMBODIMENT

Referring now to FIGS. 1 and 2, a ferrite phase shifter 10 is shown in a waveguide structure 12, here a tube of aluminum having a rectangular cross section. Disposed within such waveguide structure 12 is a ferrite assembly 14 comprised of two hollow ferrite rods 16, 18 separated by a dielectric slab 20 and having plated on outer walls thereof a conductive material 22 to form an integral structure. After plating such conductive material 22 around the ferrite rods 16, 18 and the dielectric slab 20 to form the integral structure, wires 24, 26 (for supplying drive current to the ferrite structure from any conventional source not shown) are passed through the center of the ferrite rods 24, 26 and wrapped around such rods in a conventional manner as indicated. The waveguide section 12 then is inserted into a vice, not shown, to apply opposing forces on the narrow walls thereof to deflect the wide walls as indicated in FIG. 3, the normal position of such wide walls being shown in phantom in FIG. 3. The maximum deflection, $\Delta$, approximately equals $SL^2/6TE$ where S is the elastic limit, here $27 \times 10^3$ psi and E is Young's modulus, here $10 \times 10^6$ psi of the waveguide material. It is noted that the deflection $\Delta$ is proportional to $L^2$. For the phase shifter shown in FIG. 1, the length L is 1.0 inch, the thickness T is 0.027 inches thereby allowing the wide wall of the waveguide section to be deflected without exceeding its elastic limit, by approximately 0.020 inches. When the wide wall is so deflected, the ferrite assembly 14 is inserted into the waveguide structure 12 as indicated in FIGS. 1 and 2. Once such ferrite assembly 14 is inserted the deflecting force is removed from the narrow walls of the waveguide structure thereby allowing the wide walls of such structure to return to their original positions and firmly affix the ferrite assembly 14 within the waveguide section as indicated in FIGS. 1 and 2. At the same time, any gap between the ferrite assembly 14 and the wide walls of the waveguide section 12 is eliminated. Conventional flanges 25, 27 are then affixed to the waveguide structure 12 by any suitable conductive epoxy 29. The wires 24, 26 are then passed through holes 31 formed in the narrow walls of the waveguide as indicated in FIGS. 1 and 2.

The ferrite phase shifter 10 shown in FIGS. 1 and 2 has been built and satisfactorily tested at X-band where the nominal operating wavelength, $\lambda$, is 1.18 inches. The dimensions of the ferrite phase shifter fabricated are as follows (referring to FIG. 2): the "a" dimension of the waveguide structure 12 is approximately 0.75 inches; the dielectric constant $\epsilon$ of the dielectric slab 20 is 38; the "b" dimension of the waveguide structure 12 is 0.25 inches and the dimension "c", that is the thickness of the dielectric slab 20, is 0.05 inches. It is noted that a pair of waveguide sections 30, 32 are formed between the narrow walls of the waveguide and a pair of the plated sidewalls of the ferrite assembly. The distance between one of the narrow walls of the waveguide structure and the plated wall of the ferrite assembly adjacent thereto is "d", here approximately 0.125 inches. Such waveguide sections 30, 32 are dimensioned so that they are below the cut off frequency of the dominant mode of the radio frequency energy passing through the ferrite phase shifter 10 and such energy then is inhibited from coupling to the wires 20, 24. Further, the width of the ferrite assembly, that is the dimension "e", is here approximately 0.5 inches. Such width is dimensioned so that unwanted modes are cut off from propagating through the ferrite phase shifter 10.

Having described a preferred embodiment of this invention, it is evident that other embodiments incorporating these concepts may be used. It is felt, therefore, that this invention should not be restricted to its disclosed embodiment but rather should be limited only by the scope of the appended claims.

What is claimed is:

1. A radio frequency phase shifter comprising:

a. a rectangular waveguide structure;

b. a four sided ferrite assembly disposed in such waveguide structure, such ferrite assembly having plated on the four sides thereof a conductive material, two opposite ones of such four plated sides being in contact with the wide walls of the rectangular waveguide structure; and, c. wherein opposite ones of the remaining plated sides are displaced from the narrow wall of such waveguide structure.

2. The radio frequency phase shifter recited in claim 1 wherein a pair of waveguide sections are formed between the remaining sides of such plated sides and the narrow walls of the waveguide structure, such waveguide sections being dimensioned to cut off the dominant mode of radio frequency energy passing through the phase shifter.

3. The radio frequency phase shifter recited in claim 2 wherein a drive current wire passes through one of the pair of waveguide sections.

4. The radio frequency phase shifter recited in claim 3 wherein the ferrite assembly includes two ferrite rods separated by a dielectric slab.

* * * * *